United States Patent [19]

Christie

[11] Patent Number: 4,724,560

[45] Date of Patent: Feb. 16, 1988

[54] PILLOW UTILIZING AIR AND WATER

[76] Inventor: Larry L. Christie, 12300 Fleming, #44, Houston, Tex. 77013

[21] Appl. No.: 12,842

[22] Filed: Feb. 10, 1987

[51] Int. Cl.[4] ..... A47G 9/00; A47C 27/10

[52] U.S. Cl. ..... 5/451; 5/455

[58] Field of Search ..... 5/441, 451, 452, 455, 5/450

[56] References Cited

U.S. PATENT DOCUMENTS

| | | | |
|---|---|---|---|
| 3,298,044 | 1/1967 | Saltness et al. | 5/441 |
| 3,815,165 | 6/1974 | Tobinick et al. | 5/451 |
| 3,983,587 | 10/1976 | Gorran | 5/441 |
| 4,073,021 | 2/1978 | Carlisle | 5/451 |
| 4,247,963 | 2/1981 | Reddi | 5/451 |
| 4,370,769 | 2/1983 | Herzig et al. | 5/441 |
| 4,389,742 | 6/1983 | De Witt | 5/451 |
| 4,445,240 | 5/1984 | Voorhees | 5/451 |
| 4,479,275 | 10/1984 | Fraige | 5/451 |
| 4,558,476 | 12/1985 | Linder | 5/451 |

*Primary Examiner*—Alexander Grosz

*Attorney, Agent, or Firm*—Norman B. Rainer

[57] ABSTRACT

A pillow adapted to provide yieldable support of controllable softness and thickness is fabricated of thermoplastic sheet material in a manner whereby a central air compartment is surrounded by a continuous liquid compartment, each compartment being provided with valve means. The pillow may be fabricated by the interbonding of four rectangular pieces of thermoplastic sheet material. When empty of air and liquid, the pillow occupies little storage space.

2 Claims, 3 Drawing Figures

PILLOW UTILIZING AIR AND WATER

BACKGROUND OF THE INVENTION

This invention relates to pillows which provide support for a person's head, neck and shoulders in a reclining or supine position, and more particularly concerns such pillows capable of providing yieldable support of controllable softness and thickness, but which can be placed in a storage mode occupying little space.

The use of a liquid-filled support member to uniformly support the weight of the human body is known and is used extensively in the construction of waterbed mattresses. The fact that water is a dense material has, however, limited its use as a support medium. A waterbed mattress is supported by a heavy frame and the mattress is not moved after it is inserted in the frame and filled with water. Thus, the weight of water within a waterbed mattress does not detract significantly from the use of water as a support medium since a waterbed mattress remains relatively fixed in position.

Water has not been used, however, as a support medium for objects which are moved from place to place during usage, such as pillows. Pillows, and like objects, must be relatively light in weight in order to be mobile. The use of a relatively dense support liquid, such as water, within a pillow would tend to make the pillow immobile and, therefore, unusable.

In view of the recognized usefullness of a liquid, such as water, in providing uniform support, it would be desirable to provide a construction that is able to use water as a support medium and yet is reasonably light in weight. Such a construction could then be used, for example, to provide pillows or similar objects for supporting the human body which would be relatively light and mobile.

Additionally, it would be desirable if a support construction could be provided which used water as a support medium, is relatively light in weight, and yet is relatively simple in structure. Such a construction could then be mass-produced and sold at a relatively low price.

U.S. Pat. No. 4,247,963 to Reddi discloses a pillow having a central air compartment and outer compartments that confine a layer of water. Such design affords good comfort to the user because the primary cushioning means is the layer of water which, by virtue of its displacement characteristic, conforms to the contour of the user's head, neck and shoulders. However, in the Reddi pillow, movement of the water during its displacement is primarily in a horizontal direction. Such direction of motion produces a sensation which is often disconcerting to the user.

One object of the present invention is to provide a pillow of generally rectangular shape capable of being expanded in thickness for use, but collapsible to a substantially flat storage mode when not needed.

Another object of this invention is to provide a pillow of the aforesaid objective wherein changes in thickness do not change its overall dimensions in width and length.

A further object of the present invention is to provide a pillow of the aforesaid nature having separate interior compartments for holding air and water, and the thickness of the pillow is dependent upon the quantities of air and water held by said compartments.

A still further object of the present invention is to provide a pillow of the aforesaid nature wherein said water-holding compartment is disposed exteriorly of said air-holding compartment.

Yet another object of this invention is to provide a pillow of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a pillow comprising:

(a) means defining an enclosed, generally flat, continuous air compartment having an upper outer surface and a lower outer surface, (b) sheet means for defining an enclosed upper and an enclosed lower liquid compartment which respectively bear against the upper and lower outer surfaces of said air compartment, (c) channels communicating between said upper and lower liquid compartments, said channels passing through said air compartment, and (d) valve means extending into said air compartment, and valve means extending into said liquid compartment.

In preferred embodiments of the invention, the pillow is designed to permit fabrication by the interbonding of four rectangular sheets of resilient thermoplastic material. In particularly preferred embodiments, the sheets are of plasticized polyvinyl chloride, and bonding is achieved by thermal methods.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
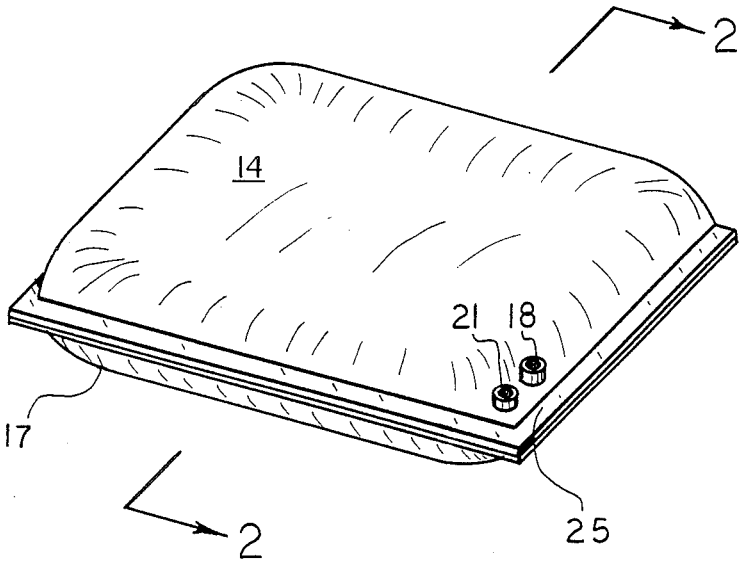
FIG. 1 is a perspective view of an embodiment of the pillow of this invention.

The terms "interior", "exterior" and expressions of similar import will have reference to the geometric center of the pillow. The terms "upper" and "lower" and equivalents thereof will have reference to the upper and lower portions, respectively, of the embodiment illustrated in FIGS. 1 and 2.

DESCRIPTION OF THE PREFERRED EMBODIMENT

Referring to the drawing, an embodiment of the pillow of this invention is shown comprised of center compartment 10 adapted to confine air, upper and lower compartments 11 and 12, respectively, adapted to confine water, and passageways 13 which communicate between said upper and lower compartments.

The pillow is fabricated of four rectangular sheets of plasticized polyvinyl chloride of identical size, said sheets comprising top sheet 14, upper interior sheet 15, lower interior sheet 16 and bottom sheet 17. Top sheet 14 is provided with first valve 18 imperviously sealed thereto and directed away from its outer surface 19. A small circular aperture 20 is positioned in sheet 14 adjacent valve 18.

Interior sheet 15 is provided with second valve means 21 imperviously sealed thereto and directed upwardly from its outer surface 22 and adapted to pass through aperture 20 for sealing engagement therewith. Sheet 15 is further provided with paired rectangular apertures 23 symmetrically disposed about the long axis 24 of the pillow.

Lower interior sheet 16 is provided with paired rectangular apertures 26 congruent with apertures 23 and aligned therewith to permit sealing interengagement of sheets 15 and 16 about the perimeters of the apertures. The sealing interengagement, which may be accomplished by induction heating devices, is caused to occur in the zones defined by the broken lines numbered 27. Said interengagement also creates said passageways 13.

In fabricating the pillow, sheets 15 and 16 are brought together, and bonded together by heat sealing about the perimeters of said aligned rectangular apertures. Valve 21 is then caused to penetrate aperture 20, and is heat sealed to the underside of sheet 14.

Finally, all four sheets are aligned, and heat sealed together along their perimeter edges, forming a flat shoulder border 25. Sheet 15 constitutes the upper boundary surface of air-confining center compartment 10, and sheet 16 constitutes the lower boundary surface of said compartment. Although the sheets of the exemplified embodiment are rectangular, alternative shapes may be employed.

Figure 2:
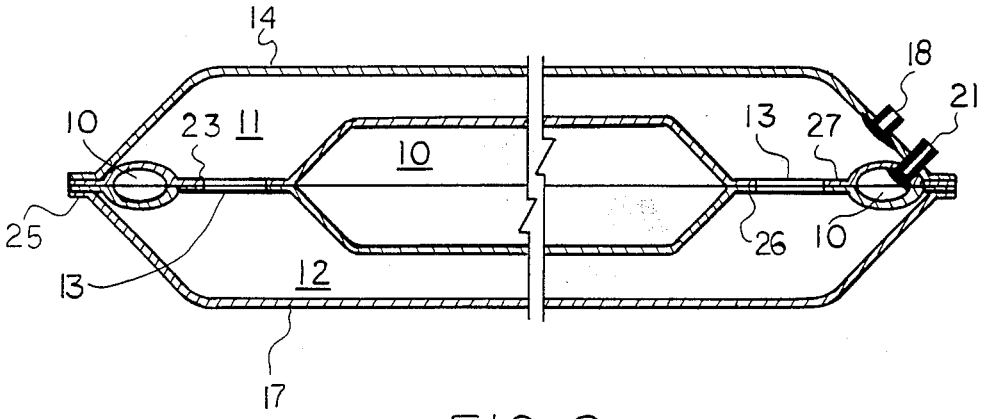
FIG. 2 is an enlarged sectional side view taken along the line 2—2 of FIG. 1.
Figure 3:
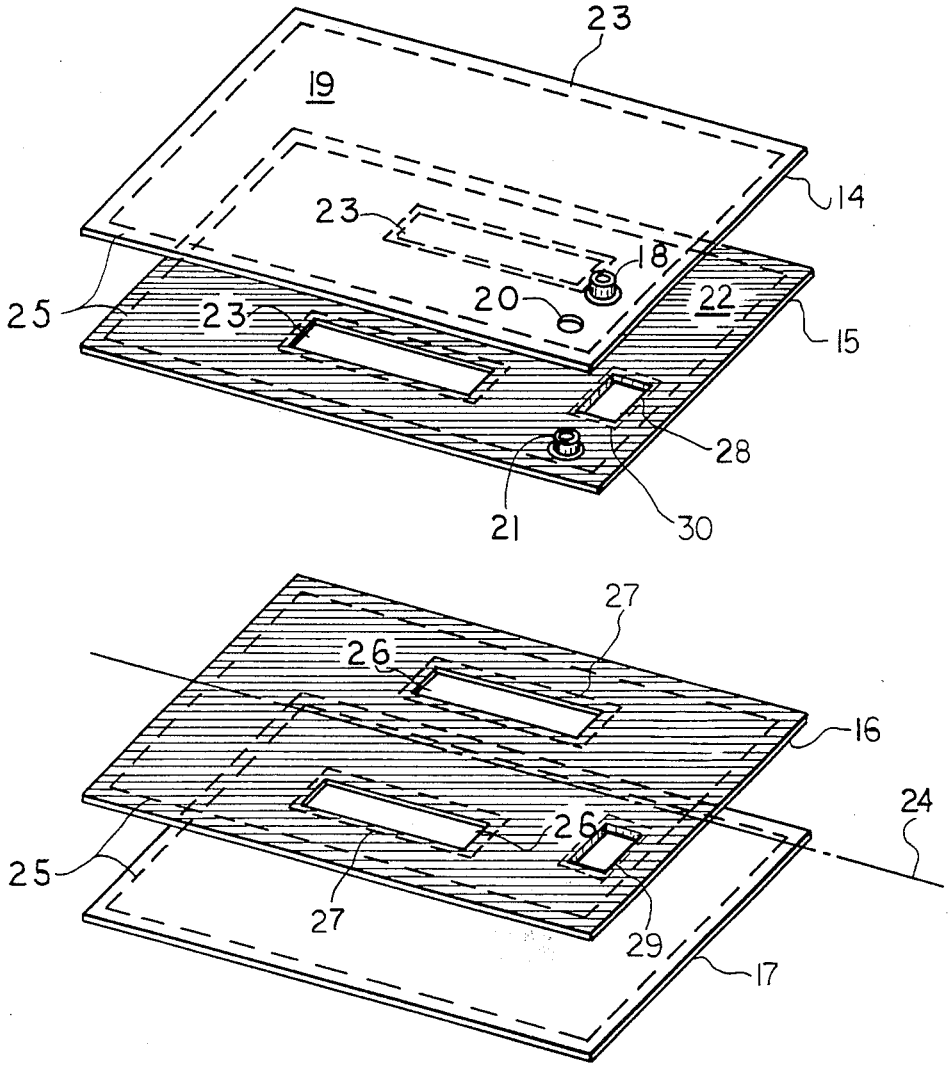
FIG. 3 is an exploded perspective view illustrating the manner of fabrication of the pillow of FIG. 1.

When air is added through valve 21, and water added through valve 18, the pillow expands to desired size, as shown in FIG. 2. It is important to note that both the air and water chambers are continuous. The vertically disposed passageways 13 cause communication between upper and lower water compartments. Because of such construction, water displaced by the head, neck or shoulders of the user will flow in directions substantially vertical to the user, thereby affording greater comfort.

Auxiliary apertures 28 and 29 may be aligned beneath valve 18 so that a secondary passageway may be formed by interengagement of the sheets in a zone 30 about the perimeters of said auxiliary apertures. Said secondary passageway promotes rapid draining of water from the pillow.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A pillow capable of providing yieldable support of controllable softness and thickness, and capable of being placed in a storage mode which occupies little space, comprising:

(a) sheet means defining an enclosed, generally flat, continuous air compartment having an upper boundary surface and a lower boundary surface, (b) sheet means defining an enclosed upper and an enclosed lower liquid compartment which respectively bear against the upper and lower boundary surfaces of said air compartment, (c) channels communicating between said upper and lower liquid compartments, said channels passing through said air compartment, (d) first valve means extending into said air compartment, and (e) second valve means extending into said liquid compartment, (f) said pillow being fabricated from four equally sized rectangular sheets of resilient thermoplastic material interbonded to form a rectangular pillow having a long center axis, (g) said channels being symmetrically disposed with respect to said axis.

2. The pillow of claim 1 wherein said thermoplastic material is plasticized polyvinylchloride, and said interbonding is achieved by thermal methods.

* * * * *